United States Patent [19]

Dilot

[11] 4,258,532

[45] Mar. 31, 1981

[54] ARRANGEMENT FOR THE FEEDING OF OBJECTS TO AND GROUPING THEM ON A BASE

[75] Inventor: Rolf M. Dilot, Uppåkra, Sweden

[73] Assignee: Tetra Pak International AB, Lund, Sweden

[21] Appl. No.: 971,085

[22] Filed: Dec. 19, 1978

[30] Foreign Application Priority Data

Dec. 19, 1977 [SE] Sweden ..... 7714397

[51] Int. Cl.[3] ..... B65B 35/40; B65B 35/44; B65B 49/08

[52] U.S. Cl. ..... 53/538; 53/207; 53/258; 53/259

[58] Field of Search ..... 53/543, 147, 244, 252, 53/497, 207, 538, 247

[56] References Cited

U.S. PATENT DOCUMENTS

| | | | |
|---|---|---|---|
| 2,613,021 | 10/1952 | Bowes | 53/538 X |
| 3,027,697 | 4/1962 | Croasdale | 53/538 X |
| 3,051,292 | 8/1962 | Sundquist et al. | 53/538 X |
| 3,732,969 | 5/1973 | Formo | 53/543 X |
| 3,964,239 | 6/1976 | Elford | 53/207 X |

*Primary Examiner*—Horace M. Culver

*Attorney, Agent, or Firm*—Burns, Doane, Swecker & Mathis

[57] ABSTRACT

An arrangement for the feeding of objects to and grouping them on a base.

In order to simplify handling and transport of milk packages it is frequent to use transport packages in the form of trays or the like, onto which a number of milk packages are placed in close stacking. For this purpose automatic machinery is used, which machinery automatically loads the milk packages on a transport package placed in position for loading. In order to avoid interruptions when an empty transport package has to be substituted for a filled one this invention suggests an arrangement according to which the milk packages are first collected in close stacking on a pre-loading surface. Thereafter, when the new transport package has been brought in correct position adjacent to the pre-loading surface, the collected milk packages are transferred onto the transport package.

6 Claims, 7 Drawing Figures

ARRANGEMENT FOR THE FEEDING OF OBJECTS TO AND GROUPING THEM ON A BASE

BACKGROUND OF THE INVENTION

The present invention relates to an arrangement for the automatic feeding of objects to and grouping them on a selectively arranged assembly surface on a flat base supporting the objects, said arrangement comprising (a) means to intermittently move and provide for the stepwise advance of the said flat base, (b) means to advance the objects intended to be fed and grouped, said means including means to stop the advance of the objects when they have reached the correct feeding position, (c) means to reciprocatingly feed said objects, by means of which the object or objects, having reached the feeding position, can be advanced towards the said base, the said feeding means being adapted so that from a rear position it can perform on the one hand a shorter feeding stroke substantially corresponding to the length of an object in the direction of feed and, on the other hand a longer feeding stroke, in the course of which the feeding means, while at the same time introducing the objects to said base which have been grouped during the shorter feeding strokes, is made to move from the said rear end position at least up to the side edge of the said selectively arranged assembly surface.

In the distribution of such objects as e.g. milk packages or other packing units from the producer to the retailer, use is frequently made of non-returnable transport packing material of a type which in principle consists of a base plate or a tray of e.g. corrugated paper, onto which plate or into which tray a number of packing units are placed in close stacking. Often, though not necessarily, the packages and the base plate are held together by means of an enveloping plastic shrink film which retains the packages in stacked configuration, so that the collective packages or transport packages can be handled in a practical manner, without individual packages falling off their stacking base.

Automatic arrangements for the forming of such transport or collecting packages have been known for a long time, and they are practically all based on the principle that the flat base piece or blank, which can be made up to a tray, is advanced to a position in front of a feeding device, by means of which one or more packing containers are simultaneously pushed in and grouped on the base which, when filled with packing containers, is transported further for wrapping with shrink film or for the folding up of the tray edges. However, it has been found that this packing or wrapping procedure is slow, or at least is not utilized to full capacity, since the time period between the completion of a collecting package and the supply of a new flat assembly base is wholly unutilized and ineffective. Since this period constitutes a relatively important part of the whole production cycle, it has been found that the production capacity can be substantially improved by use of the arrangement of the invention, which arrangement is characterized in that the distance between the feeding means, when said means is in its rear end position, and the near edge line of the supporting base exceeds twice the length of the said shorter feeding strokes, and that the feeding means is adapted to perform at least one feeding stroke while one of the said flat bases is advanced and brought into position for the said objects to be introduced.

BRIEF DESCRIPTION OF THE DRAWINGS

An embodiment of the invention will be described with reference to the drawings, wherein.

DETAILED DESCRIPTION OF THE INVENTION

Figure 7:
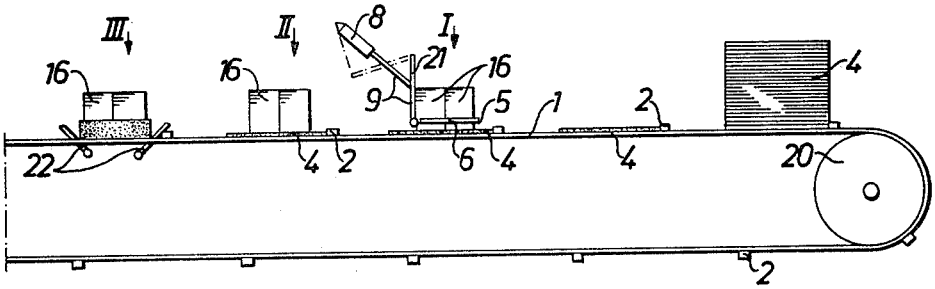
FIG. 7 shows a schematic side view of the arrangement.

An arrangement for the automatic introduction to and grouping of objects on a base or in a tray can be realized by means of an arrangement which has the general construction as shown in FIG. 7. This arrangement consists of an endless conveyor belt 1 which is conducted over driven end wheels 20. On the conveyor belt 1 drivers 2 are arranged which are adapted so that on passing a stack of blanks for base pieces or trays 4 they collect one such blank and transport it forwards in the direction of movement of the conveyor belt 1. The driving of the conveyor belt 1 is intermittent, which means that during certain periods the conveyor belt is in motion while during other periods it is motionless. With the help of the conveyor belt 1 and its drivers 2 the blanks 4 can be advanced successively into the position designated I, in which position the blank 4 remains stationary for a certain period. During this period objects, e.g. packing containers 16, are fed onto the blank in a manner later described, the objects fed being guided with the help of guide rods 5, 6, 7 so that they are correctly situated on the blank 4.

When the objects or packing containers 16 have been grouped on the blank 4, a movably arranged guide bar 7 (see FIGS. 1–5) is raised with the help of pneumatic cylinders 8 and the arms 9 supported at the points 21 to a position which is higher than the height of the objects 16, which are subsequently moved to position II with the help of the conveyor belt 1 and its drivers 2. As mentioned above, the guide bar 7 is movable, while the guide bars 5, 6 are stationary and fixed at such a height above the conveyor belt 1 that the blanks 4 can be introduced without any difficulties underneath the guide bars 5, 6.

In the present case it is assumed that the blanks 4 consist of e.g. corrugated paper and represent blanks for trays which have been provided previously with crease lines facilitating the folding process. At the station II an adhesive may be applied, for example to the fold-up lug parts of the said blanks or alternatively an adhesive layer provided in advance can be activated, while at the next position, which is designated III, the said lugs can be folded up by means of elements 22 indicated here to form a tray which surrounds the packing containers 16 placed onto the blank 4 in such a manner that they are protected and held together in the grouped configuration.

It is of course possible to design the blanks so that they are provided with a conventional lug-interlocking means so that the edge portions interlock when the edge portions are folded up to form a tray, and it is also possible to hold together the packing containers 16 on their base by enveloping the base and packing containers in a plastic shrink film, which subsequently is shrunk through the effect of heat, so that containers and base form a coherent unit that is easy to handle. The general construction indicated above of an arrangement for the formation of collective packages of objects can be modified in many ways and the description given above is merely intended to facilitate understanding of the following description of the invention which is concentrated on the feeding and grouping procedure with reference to FIGS. 1–6.

Figure 1:
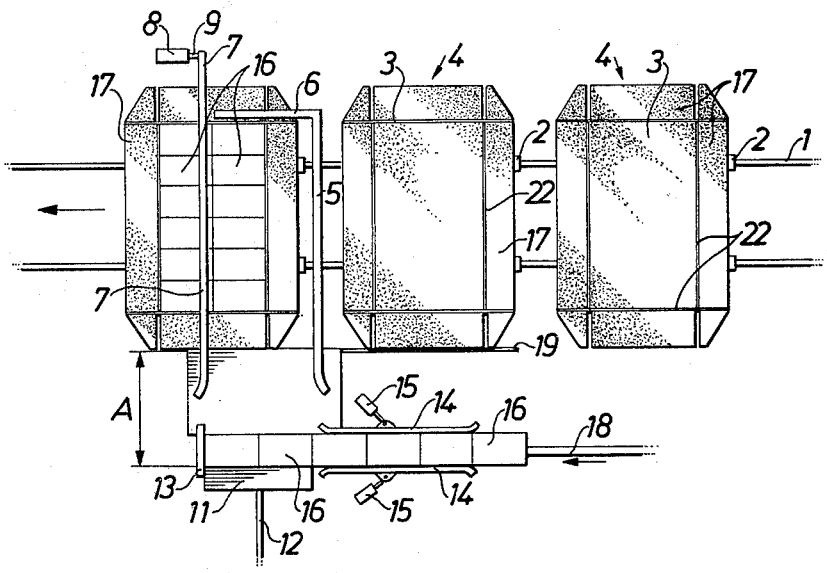
FIGS. 1–6 show the arrangement of the present invention as seen fron the top.

The arrangement shown in FIG. 1 comprises the conveyor belt 1 and its driving studs 2, and the figure also shows a conveyor belt 18 by means of which the objects, i.e., in the present case the packing containers 16, are transported from a packing machine to a stop lug 13, with a number of packing containers, i.e., in the present case two, being situated in feeding position in front of a feeding means 11 which is maneuvered by a reciprocating guide rod 12, which may be driven by a pneumatic cylinder or some other suitable mechanical device. The packing containers 16 delivered on the conveyor belt 18 are brought along between two bars or plates 14, which function at the same time as a brake or retaining device. The plates or bars 14 are maneuvred with the help of pneumatic cylinders 15, by means of which the plates 14 can be moved towards one another while they grip and brake the packing containers located between the plates 14. The feeding device also comprises a feed plate 19 which is located at the same level as the conveyor belt 18 and the upper side of the blanks or base plates 4 which are delivered by means of the intermittently driven transport device 1.

In the case depicted, the base plates consist of a blank for a tray, which blank has a rectangular assembly surface 3 which is limited by crease lines 22 dividing the assembly surface 3 from outer lugs 17, which are adapted so that they can be folded up to form a tray. The blank 4 may be made of different materials but preferably is made of corrugated paper or cardboard.

FIGS. 1–6 show a complete feeding cycle, and FIG. 1 shows how the packing containers 16 are delivered by means of the conveyor belt 18, so that the frontmost packing container 16 in the direction of transport is stopped by the stop lug or stop surface 13. At the same time a blank 4 is being advanced in front of the feeding device 11 by means of the conveyor belt 1, and a blank filled previously, on which a number of packing containers 16 have been grouped on the assembly surface 3, is removed from the feeding position by means of the conveyor belt 1 at the same time as the guide bar 7 is raised with the help of the pneumatic cylinder 8, so that the packing containers 16 can pass underneath the said guide bar. When the desired number of packing containers 16 have been delivered into feeding position in front of the feeding means 11, the feeding means 11, which is maneuvered by means of a rod 12, performs a short feeding stroke corresponding to the width of a packing container 16, at the same time as the delivery of a new blank 4 continues.

Figure 2:
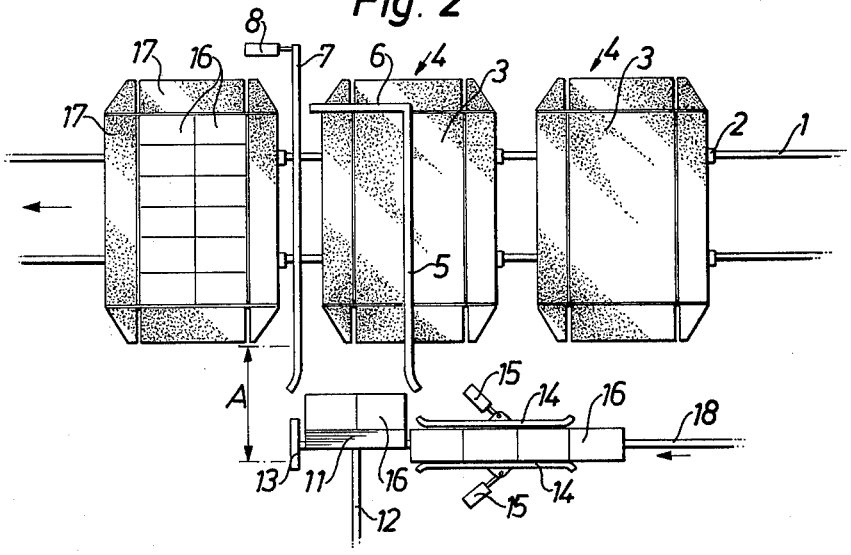
Figure 3:
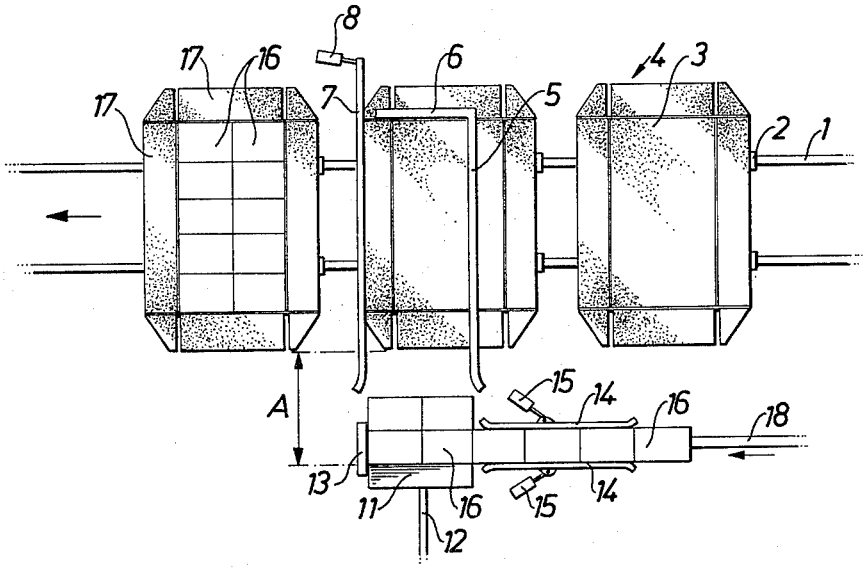
Figure 4:
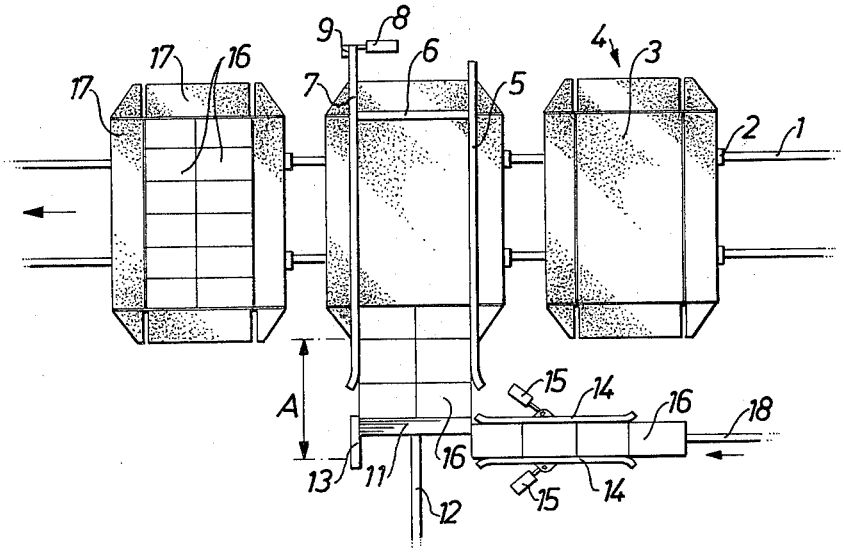

This position is shown in FIG. 2, and it should be noted that the feeding of the packing containers 16 situated in front of the feeding device 11 does not take place until the packing containers 16, which are lined up to be introduced into the feeding position, are braked or retained by means of retaining plates or retaining bars 14, in that the said plates are moved towards one another and take up between them the said packing containers at the same time as the plates perform a movement which is directed oppositely to the advance movement of the conveyor belt 18. Because the packages which are lined up to be introduced into feeding position on the one hand are retained so that they cannot be advanced any further, and on the other hand are returned a little in a direction opposite to the direction of advance, contact and friction is prevented between the packages 16 which are fed and the packing containers which are still on the conveyor belt 18. Immediately after the feeding means 11 has performed its short stroke, it returns to its rear end position which is shown in FIG. 3, while the braked or retained packages are freed owing to the retaining plates 14 being returned to their normal position, and new packing containers 16 being introduced to the feeding position, that is to say being advanced to such an extent that the front package strikes against the stop plate 13, whereupon the retaining plates once again grip the packing containers which are in line to be fed. FIG. 3 shows how new packing containers 16 have been introduced to a feeding position, whereupon the feeding device 11 once again performs a short feeding stroke in order to subsequently return to its rear end position and make room for the feeding of further packing containers into feeding position.

During the time this process, which is illustrated in FIG. 3, takes place a new package blank 4 has been delivered in front of the feeding means 11, the transport device 1 stopping so that the blank 4 remains in the said position. The feeding means 11 continues to perform feeding strokes, which means that the front packing containers 16 are successively supplied to the flat base or blank 4 while the same stands still in relation to the feeding means.

Figure 5:
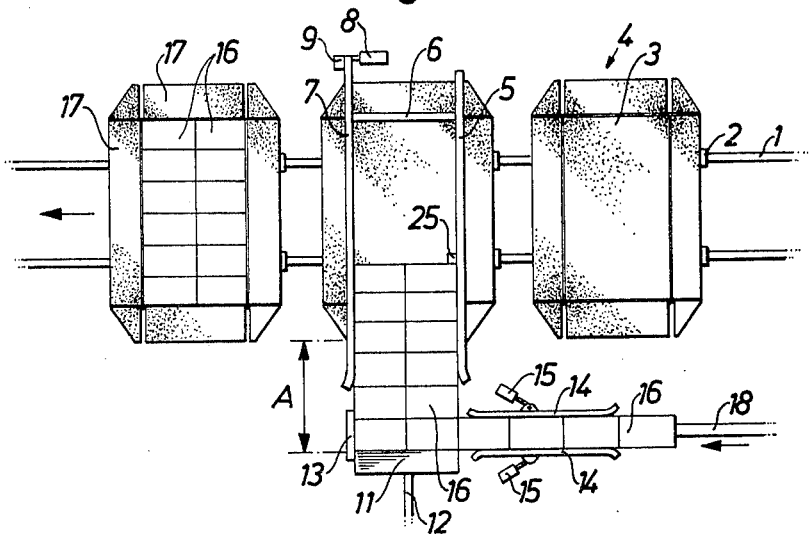
Figure 6:
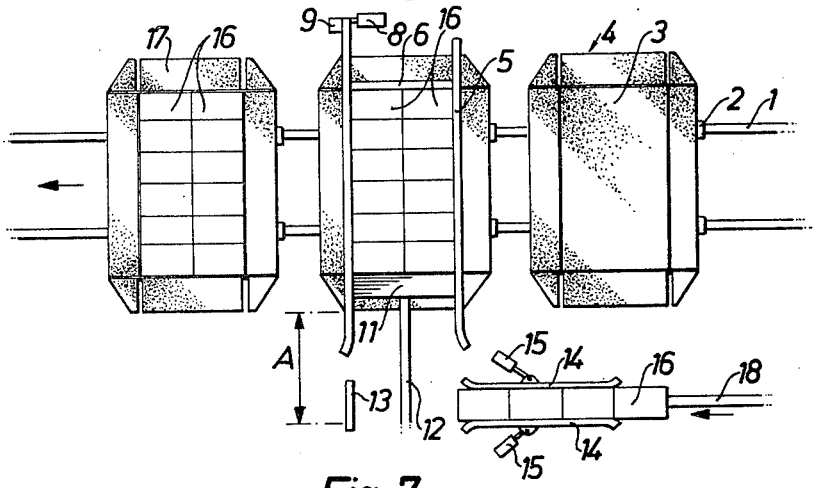

FIG. 5 depicts the position when the total number of packages intended for grouping has been delivered in front of the feeding means 11, that is to say 12 of packing containers 16. This position may be monitored e.g. with a photocell or an electric contact 25, and this photocell or contact controls the movement of the feeding means in such a manner that the feeding means, when the full number of packing containers 16 has been attained, performs a long feeding stroke that is to say a feeding stroke which extends so far forward that the front packing containers reach up to the bar 6, which means that the whole assembly plate 3 will have been filled with packing containers. When the feeding means 11 is returned to its rear end position after its long stroke, the bar 7 is lifted at the same time by means of the pneumatic cylinder 8, while the conveyor belt 1 is started simultaneously and the blank, which has been filled with packing containers, is carried away, at the same time as a new blank or base plate 4 is delivered in feeding position while the feeding means once again commences to perform short feeding strokes in order to group new packing containers for introduction to the new blank.

As is evident from the figures, the distance A between the rear position of the feeding means 11 and the nearest edge of a delivered blank 4 is so great that a number of packing containers 16 can be delivered and grouped before the frontmost packing container reaches the edge of the blank 4. This means that the feeding means 11 can perform feeding and grouping movements produced by short strokes during the time a new blank 4 is advanced into feeding position, which appreciably increases the effectiveness and capacity of the arrangement.

The cycle described above is repeated continuously, and by realizing the feeding arrangement in accordance with the invention an optimum utilization can be achieved and standstill periods of the feeding device can be avoided.

The embodiment described above is intended only to illustrate the concept of the invention, and many points can be modified within the scope of the invention regarding the appearance of the blanks as well as the appearance and function of the feeding device.

I claim:

1. Apparatus for the automatic feeding and grouping of objects on a flat base supporting the objects comprising:

means to intermittently advance a flat base member along a predetermined path, said flat base member being provided with crease lines to enable edge portions thereof to be folded upwardly;

means to advance a single row of objects intended for feeding and grouping;

means to monitor and control the advance of said objects such that their advance may be stopped upon reaching a desired feeding position;

means to sequentially advance said objects from said feeding position to a first position and a second position removed therefrom, during which movement to said first position said objects may be grouped, whereupon said grouped objects are advanced to said second position onto said flat base member, wherein the distance between said feeding position and said base member exceeds twice the length of the distance between said feeding position and said first position, with said means to sequentially advance said objects being capable of advancing said objects from said feeding position to said first position during the advance of said base member;

first and second lateral guide elements disposed above said means to advance said flat base member such that said flat base member can pass thereunder and also disposed parallel to the direction of movement of said objects and serving to guide said objects onto said flat base member, said flat base member being advanced in a direction from said first lateral guide element toward said second lateral guide element, and said second lateral guide element being movable to permit passage beneath it of said flat base member after said objects have been placed upon it; and means to fold upwardly and position edge portions of said flat base member to form lateral supporting surfaces for said objects disposed thereon subsequent to placement of said objects onto said flat base member.

2. The apparatus of claim 1 wherein said means to intermittently advance said flat base member comprises a conveyor belt.

3. The apparatus of claim 1 wherein said guide elements consist of guide bars.

4. The apparatus of claim 1 wherein said first guide element is stationary and disposed such that said flat base member may be advanced beneath said first guide element.

5. The apparatus of claim 1 wherein said second guide element is movable between a first and second position, said first position being at a height above said flat base member which is less than the height of said objects, and said second position being at a height which exceeds the height of said objects.

6. The apparatus of claim 1 wherein said means to prevent the advance of said objects includes clamping elements adapted to move the objects in a direction opposite to the direction of advance.

* * * * *